US008215636B2

(12) United States Patent
Youn

(10) Patent No.: US 8,215,636 B2
(45) Date of Patent: Jul. 10, 2012

(54) PRINTING MEDIUM TRANSFERRING DEVICE AND IMAGE FORMING APPARATUS HAVING THE SAME

(75) Inventor: Chang Min Youn, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 282 days.

(21) Appl. No.: 12/124,304

(22) Filed: May 21, 2008

(65) Prior Publication Data

US 2009/0045567 A1 Feb. 19, 2009

(30) Foreign Application Priority Data

Aug. 17, 2007 (KR) ..... 10-2007-0082727

(51) Int. Cl.
*B65H 1/00* (2006.01)
*B65H 5/06* (2006.01)

(52) U.S. Cl. ..... 271/162; 271/274

(58) Field of Classification Search ..... 271/9.09, 271/273, 274, 162, 270, 114; 399/392
See application file for complete search history.

(56) References Cited

U.S. PATENT DOCUMENTS 4,350,329 A * 9/1982 Holzhauser et al. ..... 271/9.09
4,909,497 A * 3/1990 Itabashi et al. ..... 271/9.02
5,024,431 A * 6/1991 Shimizu et al. ..... 271/263
5,913,511 A * 6/1999 Miyauchi ..... 271/9.09
6,105,953 A * 8/2000 Komuro ..... 271/9.09
6,336,629 B1 * 1/2002 Carter et al. ..... 271/274
6,354,586 B1 * 3/2002 Samoto ..... 271/127
7,455,294 B2 * 11/2008 Lin et al. ..... 271/264
7,458,577 B2 * 12/2008 Terada ..... 271/273
7,669,849 B2 * 3/2010 Liu et al. ..... 271/272
2008/0036141 A1 * 2/2008 Liu et al. ..... 271/274
2010/0007931 A1 * 1/2010 Wang et al. ..... 358/498

FOREIGN PATENT DOCUMENTS

JP 10-044570 2/1998

* cited by examiner

*Primary Examiner* — Kaitlin Joerger
*Assistant Examiner* — Patrick Cicchino
(74) *Attorney, Agent, or Firm* — Staas & Halsey LLP

(57) ABSTRACT

A printing medium transferring device and an image forming apparatus having the same, which are capable of stably conveying a printing medium supplied to a printing engine while ensuring a manual feeding path for the printing medium includes a conveyer roller which conveys a printing medium to the printing engine, a plurality of printing medium pressing devices which include pressing rollers installed along an outer circumference of the conveyer roller such that the printing medium is pressed in a normal direction of a surface of the conveyer roller, and a releasing device which allows at least one pressing roller to be moved apart from the conveyer roller in order to provide a manual feeding function.

9 Claims, 7 Drawing Sheets

PRINTING MEDIUM TRANSFERRING DEVICE AND IMAGE FORMING APPARATUS HAVING THE SAME

CROSS-REFERENCE TO RELATED APPLICATION

This application claims all benefits accruing under 35 U.S.C. §119 from Korean Patent Application No. 2007-82727, filed on Aug. 17, 2007 in the Korean Intellectual Property Office, the disclosure of which is incorporated herein by reference.

BACKGROUND OF THE INVENTION

1. Field of the Invention

Example embodiments of the present invention relate to an image forming apparatus. More particularly, example embodiments of the present invention relate to a printing medium transferring device and an image forming apparatus having the same, which are capable of stably conveying printing media supplied to a printing engine while securing a manual feeding path of the printing media.

2. Description of the Related Art

Generally, image forming apparatuses print mono images (i.e., non-color images) or color images on printing media (e.g., paper) according to image signals, and types thereof include a laser printer, an ink-jet printer, a copy machine, a multi-functional printer, and a facsimile. Image forming schemes for the various image forming apparatuses mainly include an electro-photography scheme, in which a light beam is irradiated onto a photo-sensitive member to form an electrostatic latent image, and toner is applied onto the electrostatic latent image to form an image that is transferable onto the printing media; and an ink-jet scheme in which ink is directly sprayed on to surfaces of the printing media according to the image signals.

Such image forming apparatuses include a printing medium supplying device, a pick-up device, and a printing medium transferring device. The printing medium supplying device stores a plurality of the printing media such that a printing operation is continuously performed with the supply of the plurality of the printing media. The pick-up device picks up the plurality of the printing media that are stored in the printing medium supplying device one at a time. The printing medium transferring device conveys the picked up printing media to a printing engine of the image forming apparatuses.

Generally, in order to reduce a size of a image forming apparatus, the printing medium supplying device is installed below the printing engine, and a convey direction of a printing medium that is picked up and conveyed to the printing engine in the image forming device is changed at least once. In addition, a curvature in a convey path of the printing medium located in a path curving region of the image forming apparatus, where the convey direction of the printing medium is changed, exerts a great influence on a height of the image forming apparatus. In other words, if there is a great curvature in the path curving of the printing medium, the height of the image forming apparatus increases. In contrast, if there is a small curvature in the path curving of the printing medium, the height of the image forming apparatus may be reduced.

Recently, various attempts have been made to reduce the height of the image forming apparatus in order to introduce a compact image forming apparatus. To this end, various attempts have been made to develop a printing medium transferring device having a small curvature in the path curving region where the convey direction of the printing medium is changed.

Although the reduction of the curvature where the convey direction of the printing medium is changed in the path curving region may reduce the height of an image forming apparatus, convey resistance of the printing medium is increased thereby, and a slip occurs between a roller and the printing medium that is being conveyed in the path curving region. Accordingly, noise from the image forming apparatus and curling of the printing medium may occur.

In addition, since an image forming apparatus employing a printing medium transferring device having a small curvature in the path curving region, where a convey direction of the printing medium is changed, cannot easily secure a manual feeding path for the printing medium, a manual feeding function for the printing medium cannot be realized.

SUMMARY OF THE INVENTION

Accordingly, it is an aspect of the present invention to provide a printing medium transferring device and an image forming apparatus having the same, which are capable of minimizing a curvature in a convey path of the printing medium located in a path curving region of the image forming apparatus, where a convey direction of the printing medium is changed, thereby minimizing a height of the image forming apparatus and securing a manual feeding path for the printing medium.

Additional aspects and/or advantages of the invention will be set forth in part in the description which follows and, in part, will be obvious from the description, or may be learned by practice of the invention.

The foregoing and/or other aspects of the present invention are achieved by providing a printing medium transferring device to guide a printing medium through a curved path in an image forming apparatus, including a conveyer roller which conveys the printing medium along the curved path to a printing engine of the image forming apparatus, a plurality of printing medium pressing devices which respectively include a pressing roller, and are installed along an outer circumference of the conveyer roller such that the printing medium is pressed in a normal direction to a surface of the conveyer roller, and a releasing device which allows at least one pressing roller to be moved apart from the conveyer roller in order to provide a manual feeding function of the printing medium into the curved path.

According to an aspect of the present invention, the releasing device includes a guide lever which is rotatably installed in the image forming apparatus to release a pressing state of the pressing roller through a rotation thereof.

According to an aspect of the present invention, the printing medium pressing device further includes a support shaft, which rotatably supports the pressing roller, and a compression spring, which elastically supports the support shaft such that the pressing roller is pressed toward a center of the conveyer roller, and wherein the guide lever has a hook shape in order to guide the support shaft in a direction that presses the compression spring through a rotation thereof.

According to an aspect of the present invention, the guide lever is coupled to a manual path (MP) cover and rotates in order to guide a printing medium for the manual feeding function of the image forming apparatus.

According to an aspect of the present invention, the printing medium pressing device further includes a frame which supports the support shaft and the compression spring, and a pair of support members installed at two opposite side portions of the printing medium pressing device in order to support the frame.

According to an aspect of the present invention, the releasing device includes a driving motor which generates a rotational force, and a power transformation device which converts the rotational force of the driving motor into a linear movement of components of the releasing device.

According to an aspect of the present invention, the components of the releasing device in the power transformation device includes a conveyer screw which cooperates with a rotary shaft of the driving motor, and a conveyer member which is couple to the conveyer screw to perform the linear movement and allows the pressing roller to move back and forth accordingly.

According to an aspect of the present invention, the releasing device includes a solenoid which generates a magnetic field when a current is applied thereto, and a conveyer member which moves back and forth according to the magnetic field such that the pressing roller moves back and forth accordingly.

It is another aspect of the present invention to provide an image forming apparatus including a printing engine which is installed within the image forming apparatus to print an image on a supplied printing medium, a conveyer roller which conveys the printing medium to the printing engine, a plurality of printing medium pressing devices which respectively include a pressing roller, and are installed along an outer circumference of the conveyer roller such that the printing medium is pressed in a normal direction to a surface of the conveyer roller, and a releasing device which allows at least one pressing roller to be moved apart from the conveyer roller in order to provide a manual feeding function of the image forming apparatus.

In another aspect of the present invention, an image forming apparatus, includes: a printing engine to form images on printing media; a printing medium supply device to store and provide the printing media; a convey path followed by the printing media that is situated between the printing engine and the printing medium supply device, the convey path including a curve where the printing media changes direction of travel from a first direction to a second direction; a conveyer roller situated at an inner side of the curve to change the direction of travel of the printing media; and a printing media transferring device situated at an outer side of the curve and engaged to the conveyer roller in cooperation to change the direction of travel of the printing media, wherein the printing media transferring device is partially disengaged to generate another path to introduce a printing medium not from the printing medium supply device.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
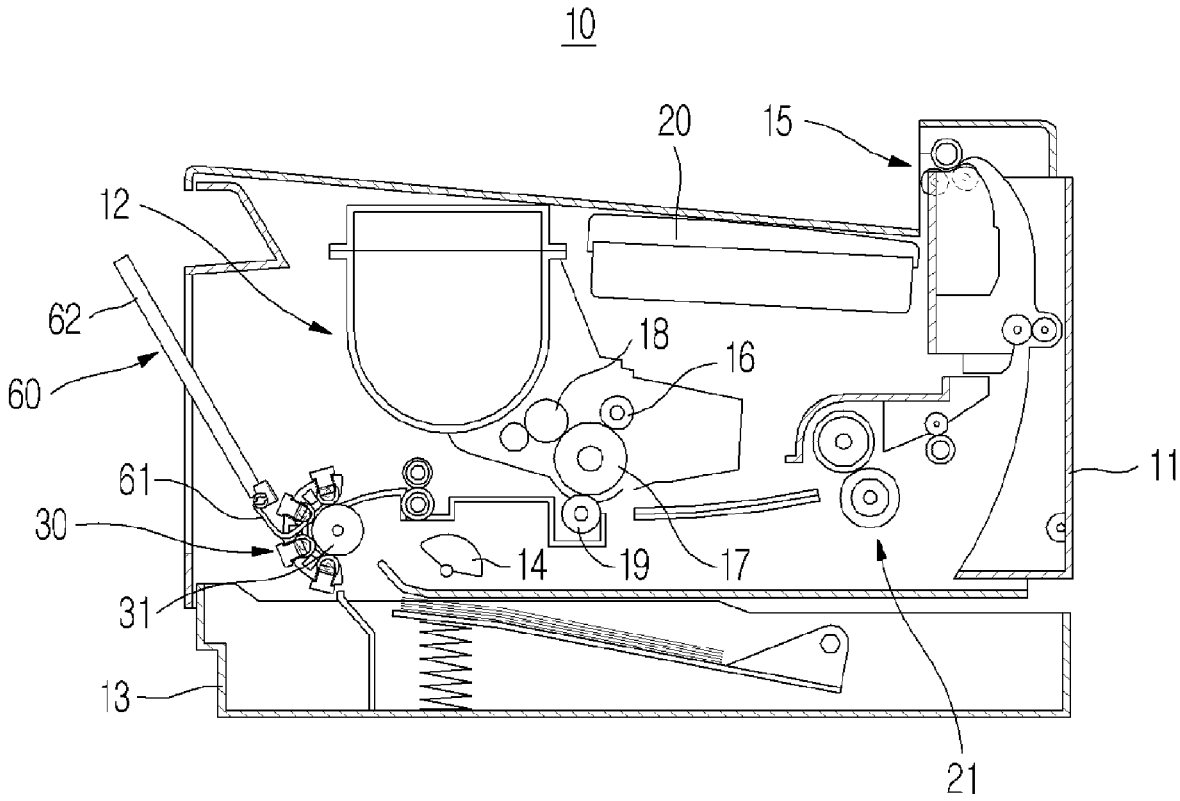
FIG. 1 is a side section view schematically showing an image forming apparatus according to an example embodiment of the present invention.

Reference will now be made in detail to embodiments of the present invention, examples of which are illustrated in the accompanying drawings, wherein like reference numerals refer to the like elements throughout. The example embodiments are described below in order to explain the present invention by referring to the figures.

Shown in FIG. 1 is an image forming apparatus 10 according to an example embodiment of the present invention. The type of an image forming apparatus shown in FIG. 1 is a laser printer which forms a visible image by applying a developer onto a photo-sensitive member 17 formed thereon with an electrostatic latent image and transferring the visible image to a printing medium.

The image forming apparatus 10 comprises a body 11, a printing engine 12, a printing medium supplying device 13, a pick-up device 14, and a printing medium transferring device 30. In the example embodiment shown in FIG. 1, the body 11 forms an outer shape of the image forming apparatus 10. The printing engine 12 prints an image onto a supplied printing medium. The printing medium supplying device 13 has a plurality of printing media stacked therein in order to supply the printing media, and is detachably coupled to the body 11. The pick-up device 14 picks up the printing media from the printing medium supplying device 13 one at a time. The printing medium transferring device 30 conveys each picked up printing medium to the printing engine 12.

When starting a printing operation, the image forming apparatus 10 operates the pick-up device 14 to pick up each printing medium from the printing medium supplying device 13 and conveys the printing medium to the printing engine 12. After the printing medium is conveyed to the printing engine 12 by the printing medium supplying device 13 and is printed with an image, the printing medium is discharged to the outside of the printing medium through a printing medium discharging unit 15.

While the printing medium is being picked up and conveyed to the printing engine 12, a light beam irradiated from a light irradiation unit 20 according to an image signal is incident on a surface of the photo-sensitive member 17. Prior to being shown with the light beam, the photo-sensitive member 17 is charged with a predetermined potential by a charging device 16, so as to form an electrostatic latent image.

In addition, a development roller 18 applies toner particles onto an area of the electrostatic latent image formed on a surface of the photo-sensitive member 17, so that a visible image is formed on the surface of the photo-sensitive member 17. The visible image is transferred onto a surface of the printing medium conveyed by a transfer roller 19. Thereafter, the visible image is fused by heat and pressure when the printing medium passes through a fixing device 21, so that the visible image is fixed on the surface of the printing medium. The printing medium having passed through the fixing device 21 is discharged to the outside of the body 11 of the image forming apparatus through the printing medium discharging unit 15.

Such a series of image forming processes can be continuously performed. In such a case, the pick-up device 14 and the printing medium transferring device 30 continuously supply the printing media, which have been stacked in the printing medium supplying device 13, to the printing engine 12. The printing medium transferring device 30 changes the convey direction of the printing media.

As opposed to the automatic feeding of the printing medium by the printing medium supplying device 13, to supply the printing medium manually, a releasing device is provided at a first side of the printing medium transferring device 30 in order to secure a manual feeding path thereof, whose detail will be described later.

Figure 2:
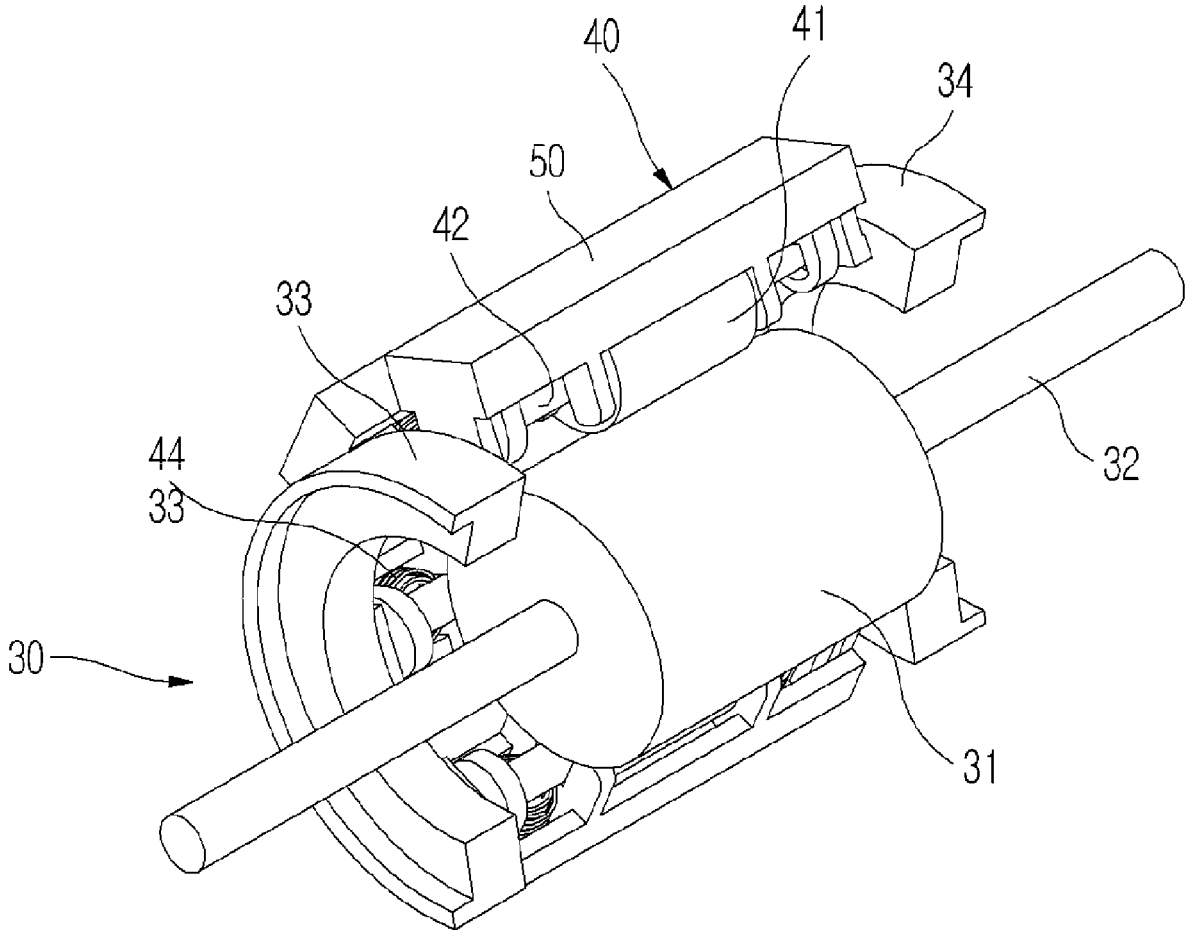
FIG. 2 is a perspective view schematically showing a printing medium transferring device of an image forming apparatus according to an example embodiment of the present invention.
Figure 3:
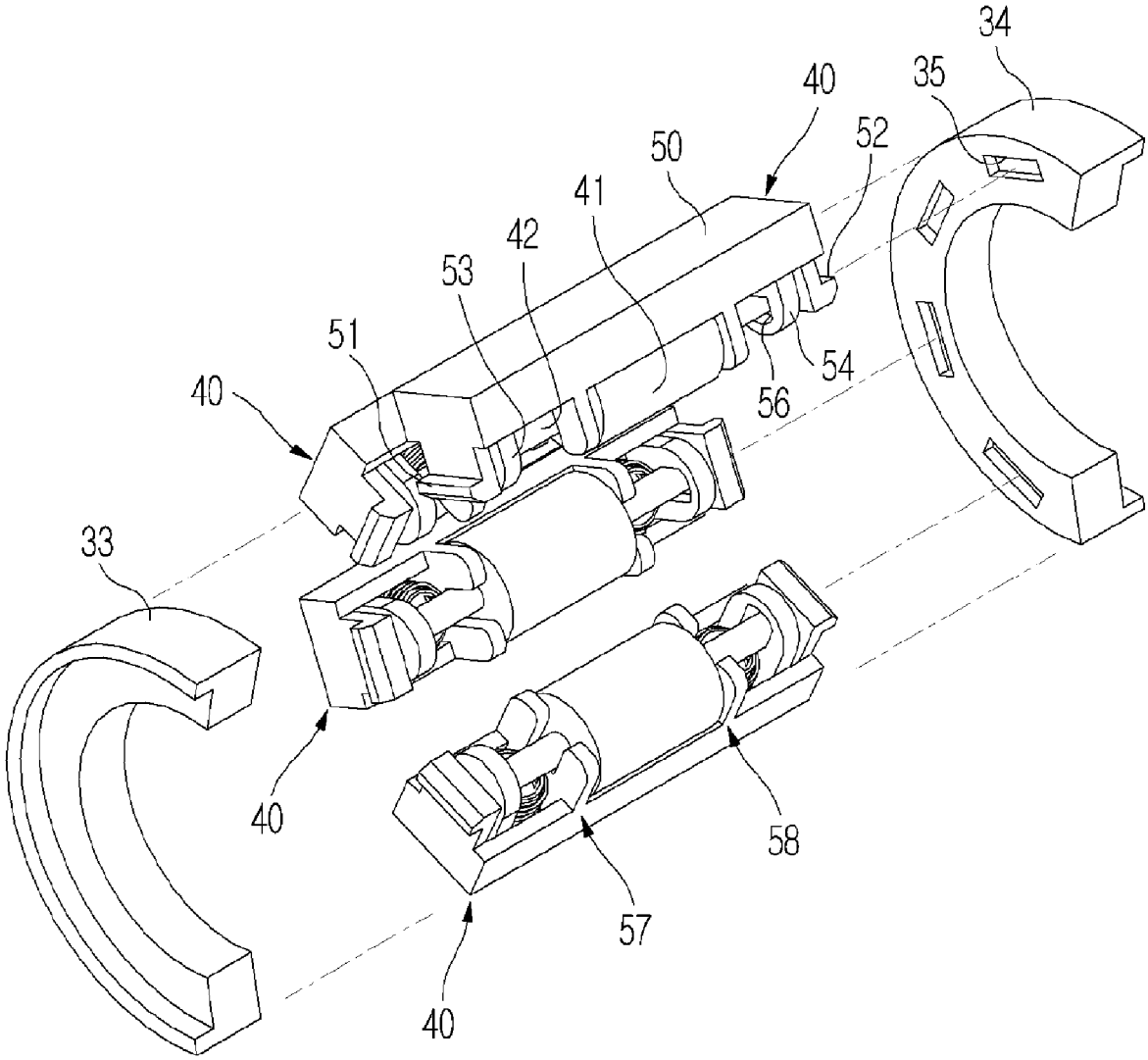
FIG. 3 is an exploded perspective view showing a portion of a printing medium transferring device of an image forming apparatus according to an example embodiment of the present invention.

Referring to FIGS. 2 and 3, the printing medium transferring device 30 comprises a conveyer roller 31, which conveys the picked up printing medium as the conveyer roller 31 rotates, and a plurality of printing medium pressing devices 40, which press the printing medium to a surface of the conveyer roller 31.

The conveyer roller 31 is supported by a roller shaft 32 that receives a driving force so as to rotate in a predetermined direction together with the roller shaft 32. The conveyer roller 31 conveys the printing medium by using friction generated between the printing medium and the conveyer roller 31.

The printing medium pressing devices 40 are spaced apart from each other by a predetermined interval and placed around the conveyer roller 31 in a rotational direction of the conveyer roller 31. Each printing medium pressing device 40 comprises a pressing roller 41, which presses the printing medium against the conveyer roller 31 in a normal direction to the surface of the conveyer roller 31, a pair of compression springs 44, which urges the pressing roller 41 against the conveyer roller 31 for the pressing roller 41 to perform a pressing operation toward the center of the conveyer roller 31, and a frame 50, which supports the pressing roller 41 and the compression spring 44.

The printing medium pressing devices 40 are coupled to a pair of support members 33 and 34 installed at both ends of the printing medium pressing device 40. The frame 50 is provided at both ends thereof with coupling protrusions 51 and 52, while the support members 33 and 34 comprise coupling grooves 35 that correspond to the coupling protrusions 51 and 52. When the coupling protrusions 51 and 52 of each frame 50 are engaged with the coupling grooves 35 of the support members 33 and 34, each frame 50 is coupled to the paired support members 33 and 34 to be supported thereby. As shown in FIGS. 2 and 3, the coupling grooves 35 are shaped to be fitted to ends of the coupling protrusions 51 and 52. Also, the support members 33 and 34 are semicircular in shape, and have curvatures that correspond to or closely match that of the conveyer roller 31. The support members 33 and 34 are situated about the conveyer roller 31 to correspond to the change in the convey direction of the printing medium.

The pressing roller 41 is rotatably supported on a support shaft 42 fixed to the frame 50, and makes contact with the conveyer roller 31 to rotate by friction with the conveyer roller 31. Further, each frame 50 includes recessed supporters 53 and 54 to respectively receive each end of the support shaft 42, and forked supporters 57 and 58 to respectively support the support shaft 42 between prongs of its forks. The recessed supporters 53 and 54 are located towards each end of the frame 50, and are adjacent to the coupling protrusions 51 and 52. The forked supporters 57 and 58 are positioned towards the interior of the frame 50 to receive the pressing roller 41 in a space defined between the forked supporters 57 and 58. Additionally, each compression spring 44 is located between the recessed supporter 53 and the forked supporter 57, and between the recessed supporter 54 and the forked supporter 58. Each spring 44 urges the respective ends of the support shaft 42 in one direction. In other example embodiments, instead of the compression spring 44, the support shaft 42 may be urged by another type of elastic member (such as rubber), or another device. In another example embodiment, the shaft 42 may be received directly into the coupling protrusions 51 and 52 instead of the recessed supporters 53 and 54. In other example embodiments, there may be a plurality of rollers 41 for each frame 50, and each roller 41 may have its own support shaft 42 so as to be independently rotatable.

Referring again to FIGS. 3 and 4, a plurality of the printing medium pressing devices 40 are provided around the conveyer roller 31 in an arrangement that corresponds to or closely matches the curvature of the roller 31. The printing medium pressing device 40 comprises the pressing roller 41, which has a curvature radius smaller than that of the conveyer roller 31 and which is in contact with a surface of the conveyer roller 31; and the compression spring 44, which elastically supports the pressing roller 41 such that the pressing roller 41 performs a pressing operation in a normal direction of the surface of the conveyer roller 31. The printing medium pressing device 40 has both ends coupled to the support members 33 and 34 such that the pressing rollers 41 maintain a predetermined interval and a predetermined pressing force along the circumference of the conveyer roller 31. The printing medium pressing device 40 mainly operates to facilitate automatic feeding of the printing medium by receiving the printing medium from the printing medium supplying device 13 and forwarding the printing medium to the printing engine.

Figure 4:
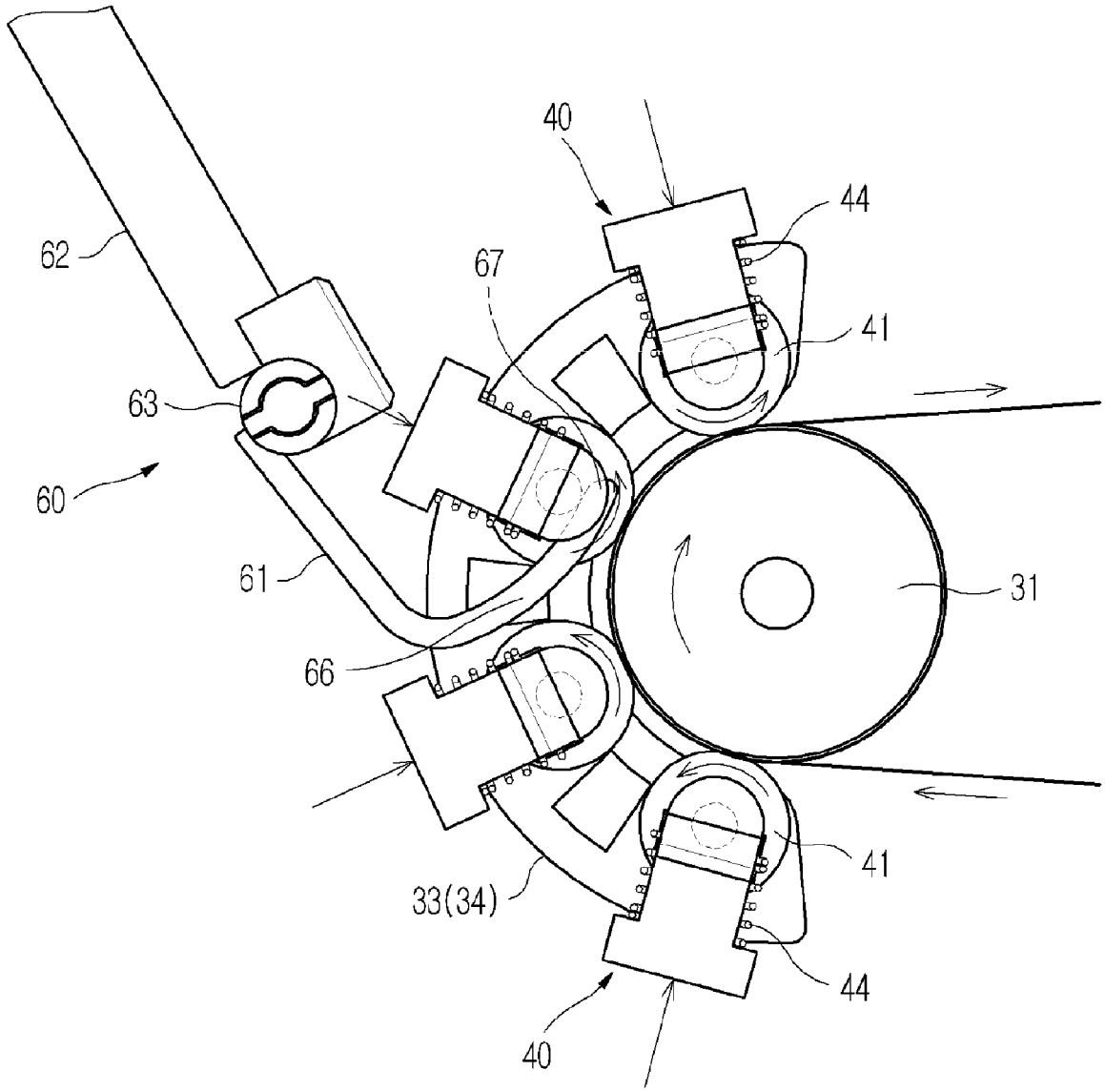
FIG. 4 is a side sectional view of a releasing device according to an example embodiment of the present invention.
Figure 5:
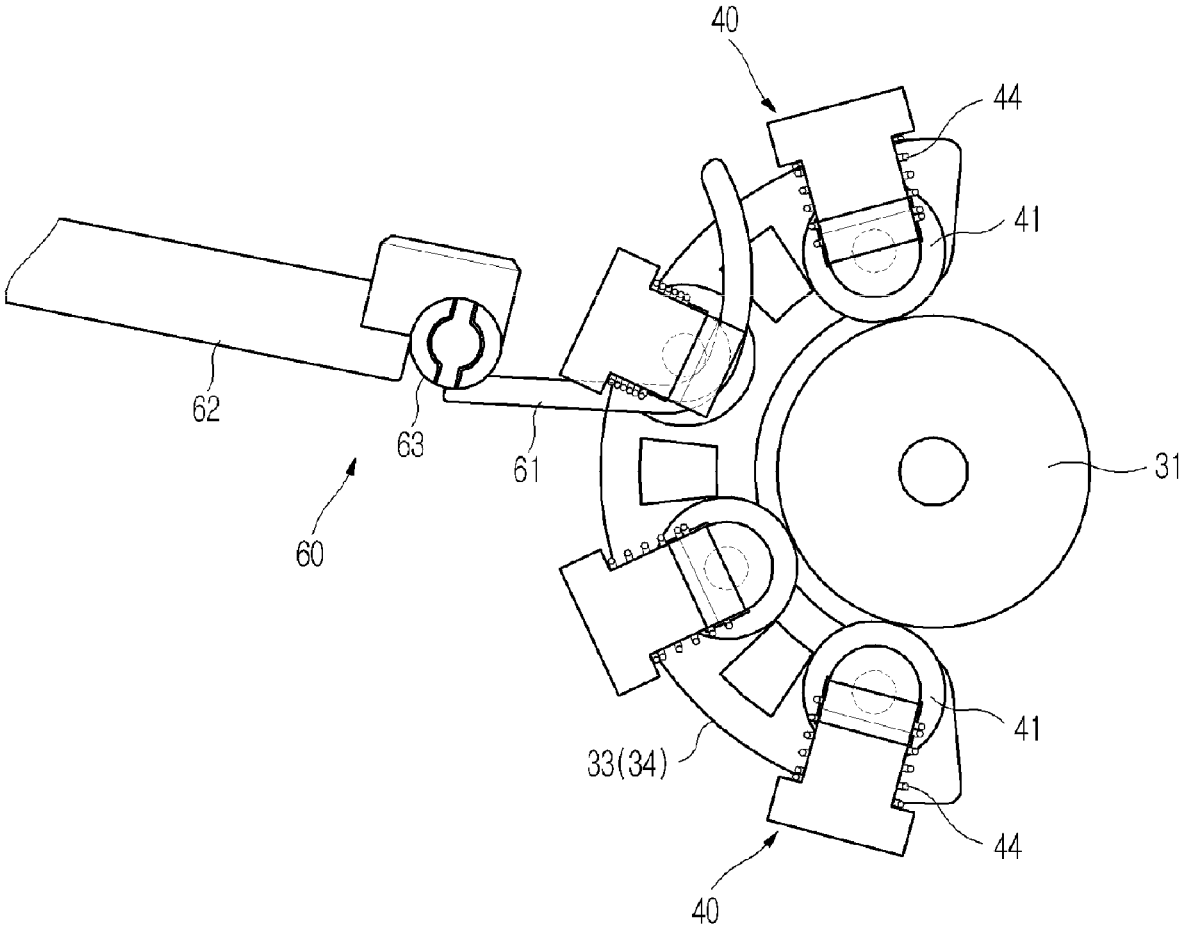
FIG. 5 is a side sectional view showing a guide lever of FIG. 4 after a releasing operation is completed by the guide lever.

Shown in FIG. 4 is a releasing device 60 used to release the pressing roller 41 from its pressing state against the conveyer roller 31 to secure a space to manually feed the printing medium into the convey path of the printing medium such that a manual feeding function can be performed if necessary. To this end, the releasing device 60 comprises a guide lever 61, a manual path (MP) cover 62, and a rotary shaft 63. As shown in FIGS. 4 and 5, the guide lever 61 guides the pressing roller 41 in order to release the pressing roller 41 from pressing against the conveyer roller 31. The MP cover 62 is coupled to the guide lever 61 to guide a manually supplied printing medium along the length of the MP cover 62 for a manual feeding operation. The rotary shaft 63 forms a rotational center of the MP cover 62 and the guide lever 61. The MP cover 62 rotates about the rotary shaft 63.

The guide lever 61 has a hook shape in which the first side 66 is curved. The guide lever 61 has an end 67 to be inserted between the conveyer roller 31 and the pressing roller 41. The MP cover 62 is rotatably installed by the rotary shaft 63 so that the MP cover 62 can be rotated to a position as shown in FIG.

5 when manual feeding of the printing medium is required. The guide lever 61 is coupled to the MP cover 62 to rotate together with the MP cover 62 about the rotary shaft 63.

Accordingly, if the MP cover 62 rotates counterclockwise from the state of the MP cover 62 in the view shown in FIG. 4, to the state of the MP cover 62 shown in FIG. 5, the MP cover 62 descends. Accordingly, the guide lever 61 ascends while rotating about the rotary shaft 63 to press the support shaft 42 in a direction opposite to a pressing direction of the compression spring 44, so that the pressing roller 41 is spaced apart or pulled away from the conveyer roller 31 through a curved shape of the first side 66 of the guide lever 61.

In an example embodiment, the guide lever 61 is an elongated rod that is curved in an opposite direction from that of the support members 33 and 34. The guide lever 61 pulls on the pressing device 40 by intruding between the recessed supporter 53 and the forked supporter 57 so as to engage the support shaft 42 in a portion that is located between the recessed supporter 53 and the forked supporter 57. The portion of support shaft 42 rests on the curved part of the guide lever 61, similar to that shown in FIG. 5 by the broken outline of the portion of support shaft 42 and the curved part of the guide lever 61. When the MP cover 62 is rotated to pull the pressing roller 41 away from the conveyer roller 31, the portion of support shaft 42 is guided to roll along the guide lever 61 to be lifted. In another example embodiment, the MP cover 62 has more than one guide lever 61, for example, two. In an example embodiment with two guide levers 61, each guide lever 61 is located at a lateral side of the MP cover 62 to symmetrically pull one of the printing medium pressing devices 40 at each end thereof.

When the pressing roller 41 is spaced apart from the conveyer roller 31 as described above and shown in FIG. 5, a path for manually feeding the printing medium is generated and secured. Then, if the manually fed printing medium is introduced into a space opened up between the pressing roller 41 and the conveyer roller 31 while being guided along the length of the MP cover 62, the manually fed printing medium is supplied to the printing engine 12 (see, FIG. 1) along the remaining convey path (or direction) between the conveyer roller 31 and the pressing roller 41.

Figure 6:
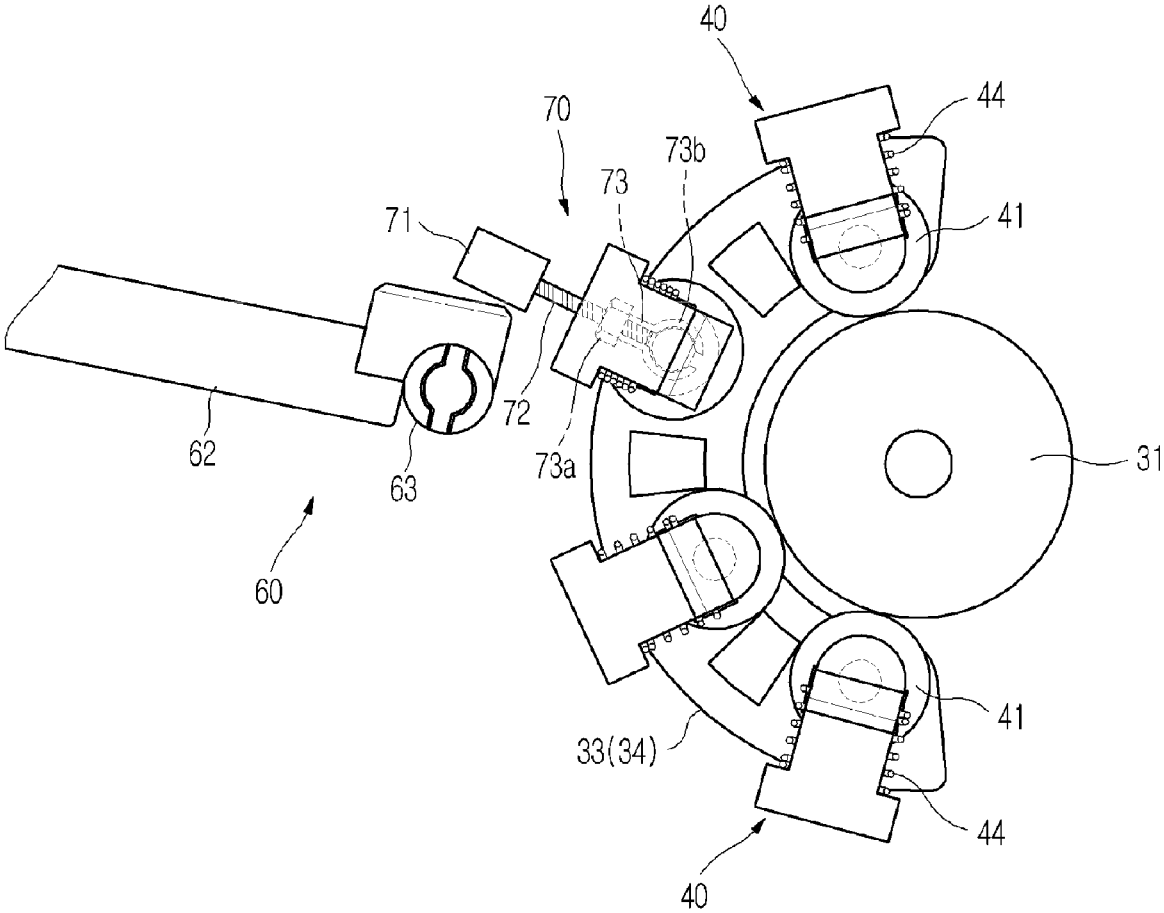
FIG. 6 is a side sectional view showing a structure of a releasing device according to another example embodiment of the present invention.

FIG. 6 shows a releasing device 70 according to another example embodiment of the present invention. The releasing device 70 comprises a driving motor 71, which generates a rotational force, and a power transformation device, which converts the rotational force of the driving motor 71 into a linear movement of components of the releasing device 70.

The power transformation device comprises a screw 72 coupled to a rotary shaft of the driving motor 71 and a guide member 73 coupled to the screw 72. The guide member 73 comprises a nut unit 73*a* and a guide unit 73*b*. The nut unit 73*a* is coupled to the screw 72 such that the nut unit 73*a* can move back and forth relative to the pressing device 40 according to a rotational movement of the screw 72. The guide unit 73*b* guides the pressing roller 41 such that the pressing roller 41 can move back and forth relative to the pressing device 40 according to the movement of the nut unit 73*a*. The guide unit 73*b* is formed with a fork to grip around a portion of the support shaft 42, as shown in FIG. 6 by the broken outline of the guide unit 73*b* and the support shaft 42.

Therefore, if the driving motor 71 is operated by receiving a current, the screw 72 is rotated so that the guide member 73 having the nut unit 73*a* coupled with the screw 72 moves back (or lifts) the pressing roller 41. When the pressing roller 41 is lifted, the pressing roller 41 is spaced apart from the conveyer roller 31, thereby securing or opening up a manual feeding path. According to an example embodiment shown in FIG. 6, the releasing operation of the pressing roller 41 is realized by using the driving motor 71 and the power transformation device, thereby a releasing operation (or the lifting operation) is performed independently from a rotating operation of the MP cover 62 about the rotary shaft 63.

According to the example embodiments shown in FIGS. 4 and 5, the releasing operation by the guide lever 61 cooperates with the rotating operation of the MP cover 62 (for manual feeding of a printing medium) so that the manual feeding path of the printing medium can be automatically secured mechanically by the rotation of the MP cover 62. However, if the MP cover 62 is put down or opened during the automatic feeding state for the printing medium in the image forming apparatus, the automatically fed printing medium may deviate from the feeding path, and cause a jam, since not all of the pressing rollers 41 will be engaged to the conveyer roller 31.

On the other hand, in the example embodiment shown in FIG. 6, since the releasing device 70 has an electromotive structure, and the releasing operation is independent from the operation of the MP cover 62, an electronic control operation of the releasing device 70 can be performed through a controller (not shown), to avoid or reduce the jam.

Figure 7:
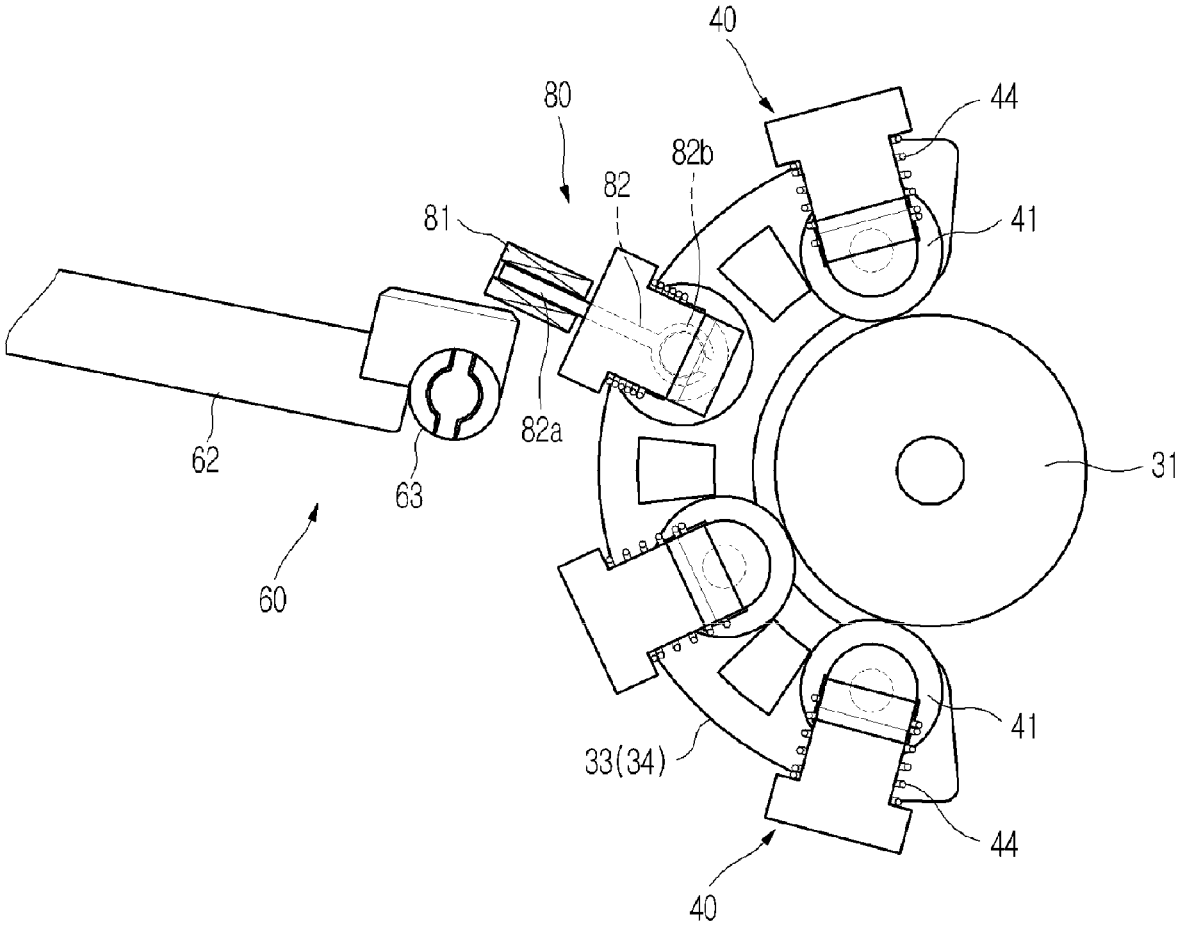
FIG. 7 is a side sectional view showing a structure of a releasing device according to yet another example embodiment of the present invention.

FIG. 7 shows a releasing device 80 according to yet another example embodiment of the present invention. The releasing device 80 according to FIG. 7 adopts components different from those of FIG. 6. The releasing device 80 of FIG. 7 comprises a solenoid 81 that generates a magnetic field as a current is applied thereto, and a guide member 82 that reciprocally moves relative to the pressing device 40 according to the magnetic field generated from the solenoid 81. The guide member 82 comprises an armature 82*a* that reciprocally moves by the solenoid 81, and a guide unit 82*b* that guides the support shaft 42.

The guide unit 82*b* is formed with a fork to grip around a portion of the support shaft 42, as shown in FIG. 7 by the broken outline of the guide unit 82*b* and the support shaft 42. According to an example embodiment shown in FIG. 7, the releasing operation of the pressing roller 41 is realized by using the armature 82*a* that reciprocally moves by the solenoid 81, and the guide unit 82*b* that guides the support shaft 42, thereby a releasing operation (or the lifting operation) is performed independently from a rotating operation of the MP cover 62 about the rotary shaft 63. Accordingly, in the example embodiment according to FIG. 7, a reciprocal motion of the guide member 82 can be performed in order to release the pressing roller 41 without the power transformation device shown in FIG. 6.

In example embodiments, although a laser printer is described as the image forming apparatus, the various image forming apparatuses according to example embodiments of the present invention comprises an ink-jet printer, a copy machine, a multi-functional printer, and a facsimile, in addition to the laser printer.

As described above, according to example embodiments of the present invention, when a printing medium is picked up from a printing medium supplying device and conveyed toward a printing engine, there is a small curvature in a convey path of the printing medium located in a path curving region of an image forming apparatus where a convey direction of the printing medium is changed to reduce a height of the image forming apparatus. In the path curving, according to example embodiments of the present invention, a manual feeding path of the printing media can be secured or opened up by a releasing device capable of releasing a pressing state of a portion of a plurality of pressing rollers. Accordingly, in addition to automatic feeding of printing media by the printing medium supplying device (e.g., a paper box), the manual feeding can be performed if necessary.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. Accordingly, it is intended, therefore, that the present invention not be limited to the various example embodiments disclosed, but that the present invention includes all embodiments falling within the scope of the appended claims.

What is claimed is:

1. A printing medium transferring device to guide a printing medium through a curved path in an image forming apparatus, comprising:

a conveyer roller which conveys the printing medium along the curved path to a printing engine of the image forming apparatus;

a plurality of printing medium pressing devices arranged in a semicircular shape having each respective end coupled to one of a pair of semicircular support members, the plurality of pressing devices respectively include a pressing roller, and are installed along an outer circumference of the conveyer roller such that the printing medium is pressed in a normal direction to a surface of the conveyer roller;

a releasing device which allows at least one pressing roller to be moved apart from the conveyer roller in order to provide a manual feeding function of the printing medium into the curved path, wherein the releasing device comprises a guide lever which is rotatably installed in the image forming apparatus to release a pressing state of the pressing roller through a rotation thereof; and a manual path (MP) cover rotatably installed in order to guide a printing medium for the manual feeding function of the image forming apparatus, wherein the guide lever is coupled to the MP cover and rotates.

2. The printing medium transferring device as claimed in claim 1, wherein the printing medium pressing device further comprises:

a compression spring, which elastically supports the support shaft such that the pressing roller is pressed toward a center of the conveyer roller, wherein the guide lever has a hook shape in order to guide the support shaft in a direction that presses the compression spring through a rotation thereof.

3. A printing medium transferring device to guide a printing medium through a curved path in an image forming apparatus, comprising:

a conveyer roller which conveys the printing medium along the curved path to a printing engine of the image forming apparatus;

a plurality of printing medium pressing devices arranged in a semicircular shape which respectively include a pressing roller, and are installed along an outer circumference of the conveyer roller such that the printing medium is pressed in a normal direction to a surface of the conveyer roller; and a releasing device which allows at least one pressing roller to be moved apart from the conveyer roller in order to provide a manual feeding function of the printing medium into the curved path, wherein the releasing device comprises a guide lever which is rotatably installed in the image forming apparatus to release a pressing state of the pressing roller through a rotation thereof, wherein the printing medium pressing device further comprises:

a support shaft, which rotatably supports the pressing roller, and a compression spring, which elastically supports the support shaft such that the pressing roller is pressed toward a center of the conveyer roller, wherein the guide lever is coupled to a manual path (MP) cover and rotates in order to guide a printing medium for the manual feeding function of the image forming apparatus.

4. An image forming apparatus comprising:

a printing engine which is installed within the image forming apparatus to print an image on a printing medium;

a conveyer roller which conveys the printing medium to the printing engine;

a plurality of printing medium pressing devices arranged in a semicircular shape having each respective end coupled to one of a pair of semicircular support members, the plurality of pressing devices respectively include a pressing roller, and are installed along an outer circumference of the conveyer roller such that the printing medium is pressed in a normal direction to a surface of the conveyer roller; and a releasing device which allows at least one pressing roller to be moved apart from the conveyer roller in order to provide a manual feeding function of the image forming apparatus, wherein the releasing device comprises a guide lever which is rotatably installed in the image forming apparatus to release a pressing state of the pressing roller through a rotation thereof, and the guide lever is coupled to a manual path (MP) cover and rotates in order to guide a printing medium for the manual feeding function of the image forming apparatus.

5. The image forming apparatus as claimed in claim 4, wherein the printing medium pressing device further comprises:

a compression spring which elastically supports the support shaft such that the pressing roller is pressed toward a center of the conveyer roller, wherein the guide lever has a hook shape in order to guide the support shaft in a direction that presses the compression spring through a rotation thereof.

6. An image forming apparatus comprising:

a printing engine which is installed within the image forming apparatus to print an image on a printing medium;

a conveyer roller which conveys the printing medium to the printing engine;

a plurality of printing medium pressing devices arranged in a semicircular shape which respectively include a pressing roller, and are installed along an outer circumference of the conveyer roller such that the printing medium is pressed in a normal direction to a surface of the conveyer roller;

a releasing device which allows at least one pressing roller to be moved apart from the conveyer roller in order to provide a manual feeding function of the image forming apparatus; and a printing medium transferring device comprising a manual path (MP) cover rotatably installed in order to guide a printing medium for the manual feeding function of the image forming apparatus, wherein the guide lever is coupled to the MP cover and rotates, wherein the releasing device comprises a guide lever which is rotatably installed in the image forming apparatus to release a pressing state of the pressing roller through a rotation thereof.

7. The image forming apparatus as claimed in claim 5, wherein the printing medium pressing device further comprises:

a frame which supports the support shaft and the compression spring, and the pair of support members installed at two opposite side portions of the printing medium pressing device in order to support the frame.

8. The printing medium transferring device as claimed in claim 2, wherein the printing medium pressing device further comprises:

a frame which supports the support shaft and the compression spring, and the pair of support members are installed at two opposite side portions of the printing medium pressing device in order to support the frame.

9. The printing medium transferring device as claimed in claim 3, wherein the guide lever has a hook shape in order to guide the support shaft in a direction that presses the compression spring through a rotation thereof.

* * * * *